US006368428B1

(12) United States Patent
Thiel et al.

(10) Patent No.: US 6,368,428 B1
(45) Date of Patent: Apr. 9, 2002

(54) METHOD OF ADJUSTING TWO SHIELDING ELEMENTS AND AN ASSOCIATED ASSEMBLY

(75) Inventors: Hermann Thiel, Siegen; Jürgen Seidel, Kreuztal; Peter Holterhoff, Olpe; Markus Cramer, Attendorn, all of (DE)

(73) Assignee: SMS Schloemann-Siemag AG, Düsseldorf (DE)

( * ) Notice: Subject to any disclaimer, the term of this patent is extended or adjusted under 35 U.S.C. 154(b) by 0 days.

(21) Appl. No.: 09/656,869

(22) Filed: Sep. 7, 2000

(30) Foreign Application Priority Data

Sep. 10, 1999 (DE) ..... 199 43 288

(51) Int. Cl.[7] ..... C21D 1/667; C21D 9/573

(52) U.S. Cl. ..... 148/640; 266/114; 266/134; 72/201

(58) Field of Search ..... 148/640; 266/114, 266/134; 72/201

(56) References Cited

U.S. PATENT DOCUMENTS 4,440,584 A * 4/1984 Takeshige et al. ..... 148/640

* cited by examiner

*Primary Examiner*—Deborah Yee
(74) *Attorney, Agent, or Firm*—Sidley Austin Brown & Wood, LLP

(57) ABSTRACT

A method of adjusting two shielding elements and including transporting a metal strip on a roller table, shielding a cooling medium from the edge regions of the metal strip with adjusting shielding elements, and adjusting the shielding elements asymmetrically with respect to the central axis of the roller table so that the temperature profile behind the shielding elements, as seen in a transporting direction of the strip, approximate to a nominal temperature profile; and an assembly for effecting the method.

17 Claims, 3 Drawing Sheets

METHOD OF ADJUSTING TWO SHIELDING ELEMENTS AND AN ASSOCIATED ASSEMBLY

BACKGROUND OF THE INVENTION

1. Field of the Invention

The present invention relates to a method of adjusting two shielding elements, with the method including:

transporting a metal strip having a predetermined width, a central axis, and edge regions on a roller table having a roller table central axis with the metal strip having a temperature profile over the width of the metal strip;

shielding a cooling medium from the edge regions of the metal strip with shielding elements, and adjusting the shielding elements so that the temperature profile behind the shielding elements, as seen in the transporting direction, is approximated to a nominal temperature profile.

The present invention also relates to an assembly including a roller table for transporting a metal strip having a predetermined width in a transporting direction, and shielding elements for shielding of a cooling medium from the edge regions of the metal strip.

2. Description of the Prior Art

Such an adjusting method and a roller table are disclosed, for example, in German document DE 32 30 866 C2.

Metal strips are cooled in order to achieve certain metallurgical properties. Since the edge regions of the metal strip, as a rule, are cooler than the central region of the strip, a cooling medium is shielded from the edge regions of the metal strip in the state-of-the-art. With such a procedure, a uniform temperature profile over the width of the strip can be achieved behind the cooling segments.

It is an object of the present invention to provide a method of adjusting two shielding elements and a roller table which permit to achieve an even more uniform temperature profile distribution in the metal strip.

SUMMARY OF THE INVENTION

This and other objects of the present invention, which will become apparent hereinafter, are achieved by adjusting the shielding elements asymmetrically with respect to the central axis of the roller table.

According to the present invention, the roller table is equipped with adjusting driving mechanisms, for adjusting the shielding elements asymmetrically with respect to the central axis of the roller table.

In accordance with the present invention, the corresponding deviations, especially a distance of the strip central axis from the central axis of the roller table, an asymmetry of the temperature profile over the width of the strip in front of the shielding elements, and an asymmetry of the temperature profile over the width of the strip behind the shielding elements are detected with appropriate sensor elements and are compensated for.

For the asymmetric adjusting of two shielding elements with respect to the central axis of the roller table, two adjusting driving mechanisms are required. The shielding elements can be adjusted mechanically either independently of one another each by its own adjusting driving mechanism or they can be adjusted together mechanically symmetrically by a first driving mechanism and mechanically asymmetrically by a second driving mechanism.

The adjusting method includes self-learning when:

the metal strip has a beginning, before the start of the strip runs into the roller table, pre-adjustments are specified or present for the adjusting driving mechanisms by a control unit, after the start of the tape runs into the roller table, the shielding elements are adjusted by the adjusting driving mechanisms to readjusted settings, the readjusted settings are transmitted to the control unit, and the control unit, based on the readjusted settings, modifies the previous pre-adjustments.

The construction of the assembly with a roller table is particularly simple if the shielding elements are disposed above the roller table, the shielding elements are constructed as longitudinal ducts extending in the transporting direction of the strip, and the cooling medium is supplied by the longitudinal ducts to transverse ducts extending transversely to the transporting direction.

If the transverse ducts are disposed between the adjusting driving mechanisms and the roller table, the adjusting elements are protected against heat and a possible rising of the metal strip.

BRIEF DESCRIPTION OF THE DRAWINGS

The objects and advantages of the present invention will become more apparent, and the invention itself will be best understood from the following detailed description of the preferred embodiment when read with reference to the accompanying drawings, wherein.

DETAILED DESCRIPTION OF THE PREFERRED EMBODIMENT

Figure 1:
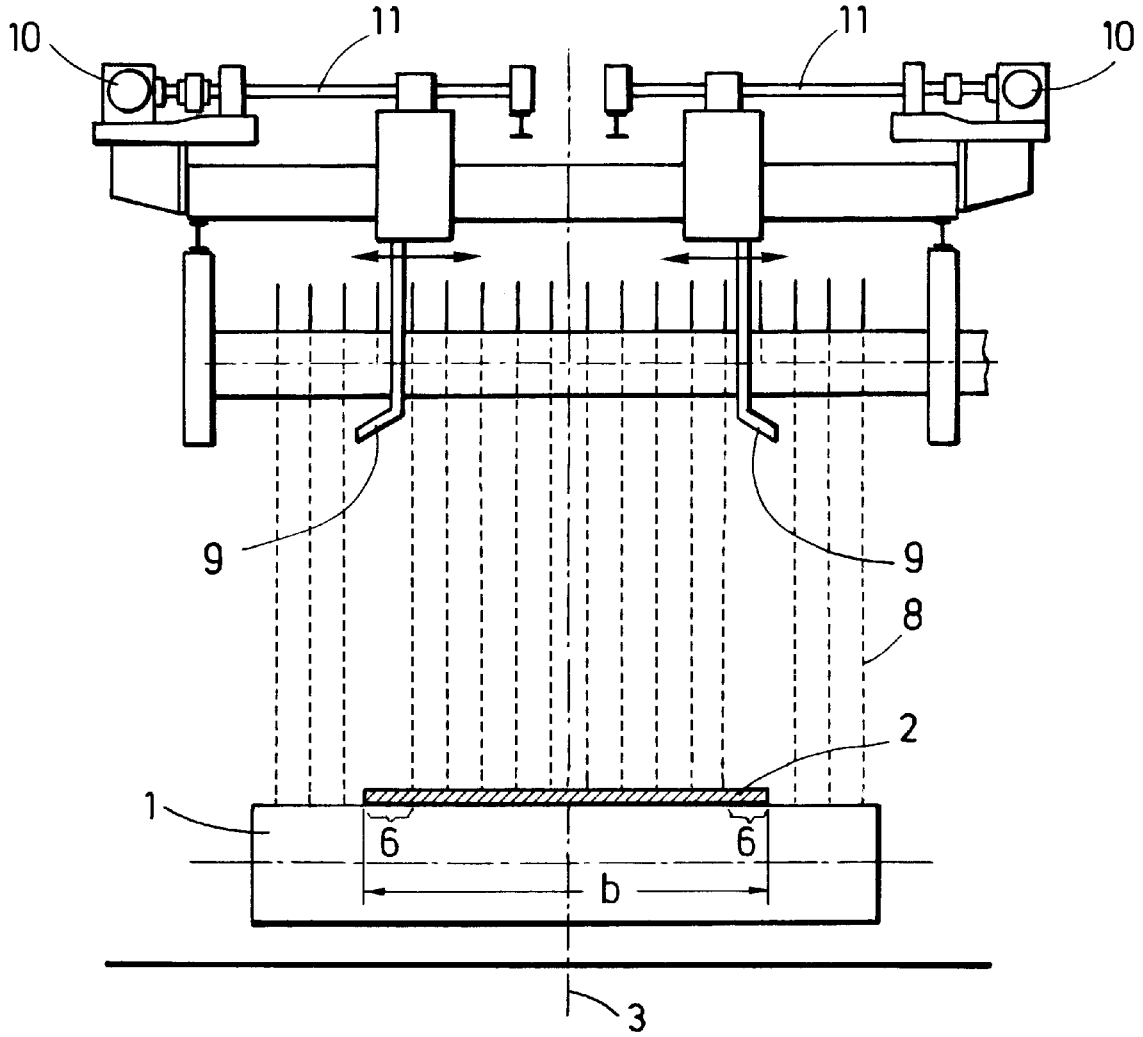
FIG. 1 shows a schematic view of a roller table, seen in the transporting direction.
Figure 2:
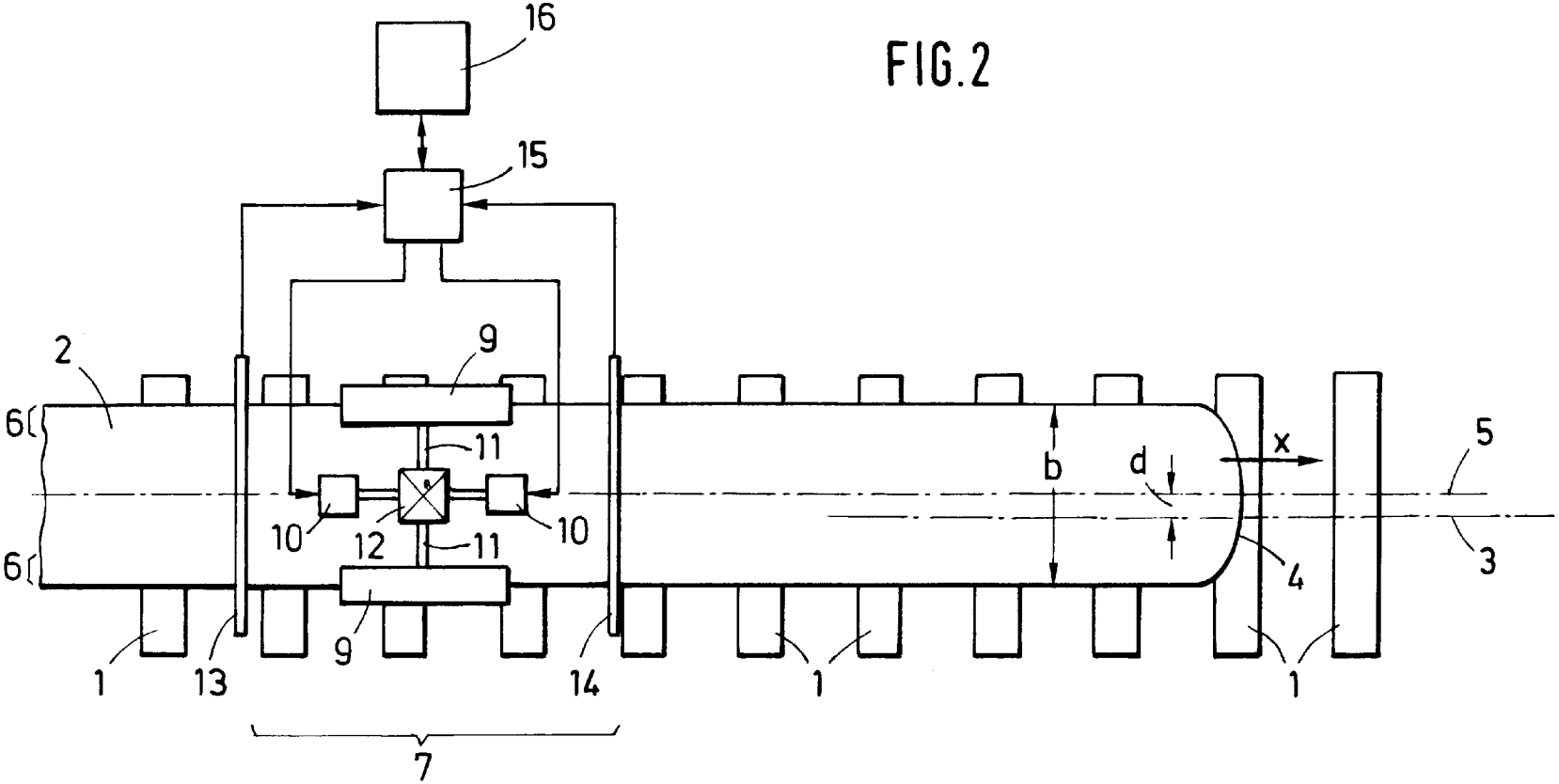
FIG. 2 shows a plan view of the roller table of FIG. 1.

According to FIGS. 1 and 2, a roller table has a plurality of transporting rollers 1, on which a metal strip 2 is transported in a transporting direction x. The roller table has a central axis 3. The metal strip has a beginning 4, a strip central axis 5, and a width b. The metal strip 2 extends over the width b from one edge region 6 to another edge region 6.

In front of a cooling line, generally labeled 7, the metal strip has a temperature profile over its width b. Behind the cooling line 7, the metal strip 2 also has a temperature profile over its width b.

In the region of the cooling line 7, the metal strip 2 is subjected to action of a cooling medium 8, such as water, and is cooled. In the region of the cooling line 7, shielding elements 9 are disposed, which shield the cooling medium 8 form the edge regions 6 of the metal strip 2. The shielding elements 9 are adjusted by the adjusting driving mechanisms 10 in such a manner, that the temperature profile over the width b of the metal strip behind the shielding elements 9, as seen in the transporting direction x, approximates a nominal temperature profile. As a rule, the nominal temperature profile is characterized by a uniform temperature distribution over the width b of the strip.

According to FIGS. 1 and 2, the shielding elements 9 are adjusted with threaded spindles 11, which are driven by the adjusting driving mechanisms 10. As shown in FIG. 1, each shielding element 9 has its own adjusting driving mechanism 10, and can be adjusted mechanically, independently of the other shielding elements 9. As shown in FIG. 2, the shielding elements 9 are coupled together over a differential gear 12, such as a planetary gear 12. In this case, the shielding elements 9 are adjusted symmetrically relative to one another by one adjusting driving mechanism and asymmetrically relative to one another by the other adjusting driving mechanism. In both cases, however, it is possible to adjust the shielding elements 9 asymmetrically with respect to the central axis 3 of the roller table.

To determine the temperature profiles, a sensor element 13 is disposed in front of and a sensor element 14 is disposed behind the shielding elements 9. Sensor elements 13 and 14 permit to detect an asymmetry of the temperature profiles over the strip width b in front of and behind the shielding elements 9, as seen in the transporting direction x. The corresponding asymmetries are entered into a control device 15, which is assigned to the adjusting driving mechanisms 10. The control device 15 then determines appropriate adjustments for the shielding elements 9, so that compensation is made for the asymmetries of the temperature profiles in front of and behind the shielding elements 9.

Outside of the width b of the metal tape, the temperature, detected by the sensor devices 13, 14 drops off abruptly. By appropriately evaluating the detected temperature profile, a distance d of the central axis 5 of the strip 2 from the central axis 3 of the roller table can therefore also be determined. It is also possible to compensate for this distance d by asymmetrically adjusting the shielding elements 9.

As already mentioned, the metal strip 2 has a beginning 4. Before the beginning 4 of the strip 2 enters the roller table, pre-adjustments, at which the shielding elements 9 are to be initially adjusted, are specified by a control unit 16 for the regulating device 15 and, with that, indirectly for the adjusting driving mechanisms 10. After the beginning 4 of the strip 2 has run into the roller table, the shielding elements 9 are then adjusted by the adjusting driving mechanisms 10 in accordance with the distance d. The readjustments are transmitted by the regulating device 15 to the control device 16. The control device 16 then modifies the pre-adjustments, providing readjustments. During the passage of a further metal strip, the shielding elements 9 are then adjusted initially according to the modified pre-adjustments. Accordingly, a self-learning behavior of the adjusting process occurs.

Figure 3:
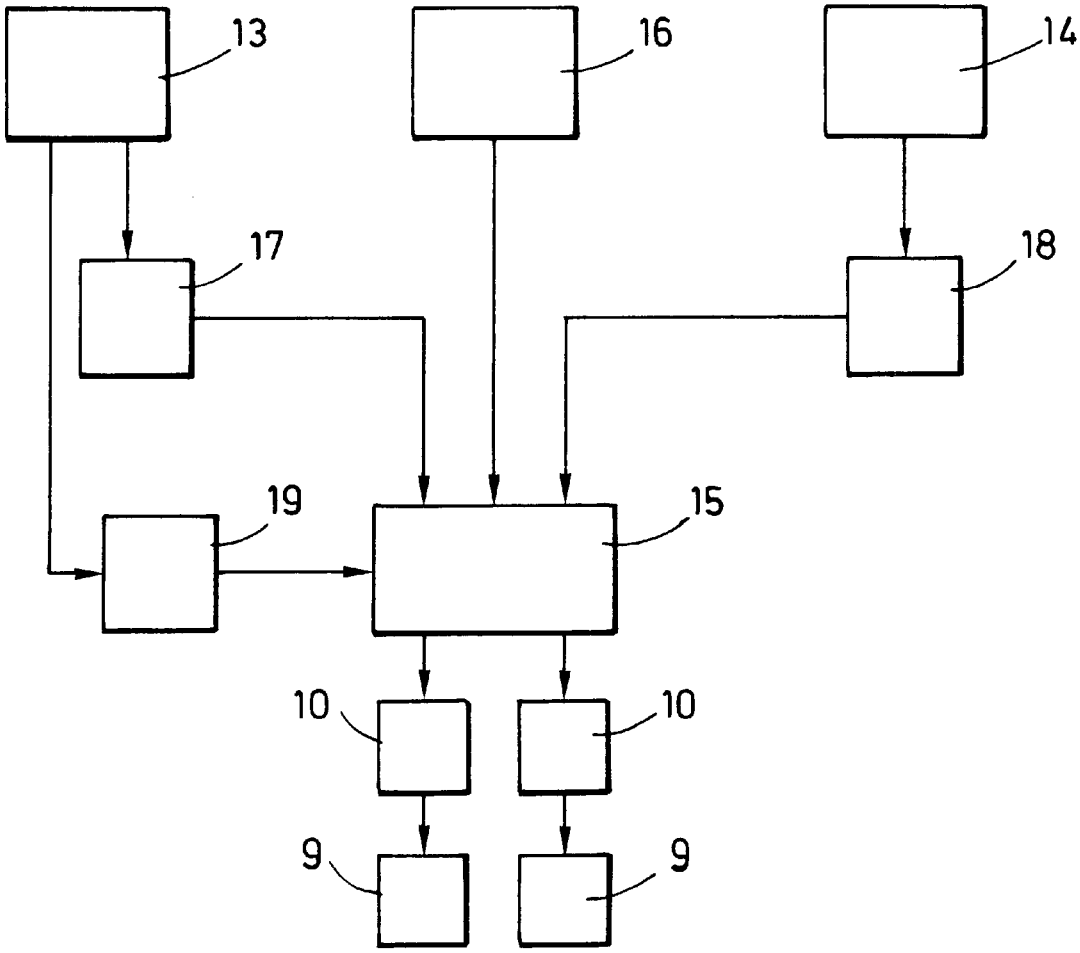
FIG. 3 shows a diagram of an adjusting method.

FIG. 3 diagrammatically shows the determination of the adjustments for the shielding elements 9. In accordance with FIG. 3, the sensor elements 13, 14 are connected with correction value determining devices 17, 18. The correction value determining devices 17, 18 determine an asymmetry value for the edge regions 6 from the temperature distribution determined in front of and behind the shielding elements 9 and, from this, determine an adjusting asymmetry for the shielding elements 9.

The sensor device 13 furthermore is connected with a device 19 for determining the position of the strip 2. This device 19 determines the distance d of the central axis 5 of the tape from the central axis 3 of the roller table from the temperature profile that has been ascertained.

The correction values as well as the distance, which have been determined, are communicated to the regulating device 15. Furthermore, pre-adjustments are specified by the control unit 16 for the regulating device 15. The regulating device 15 then determines appropriate adjustments for the shielding elements 9. After a stabilization phase, these new adjustments, (readjustments), are transmitted back to the control unit 16, so that the latter can modify the pre-adjustments correspondingly.

Figure 4:
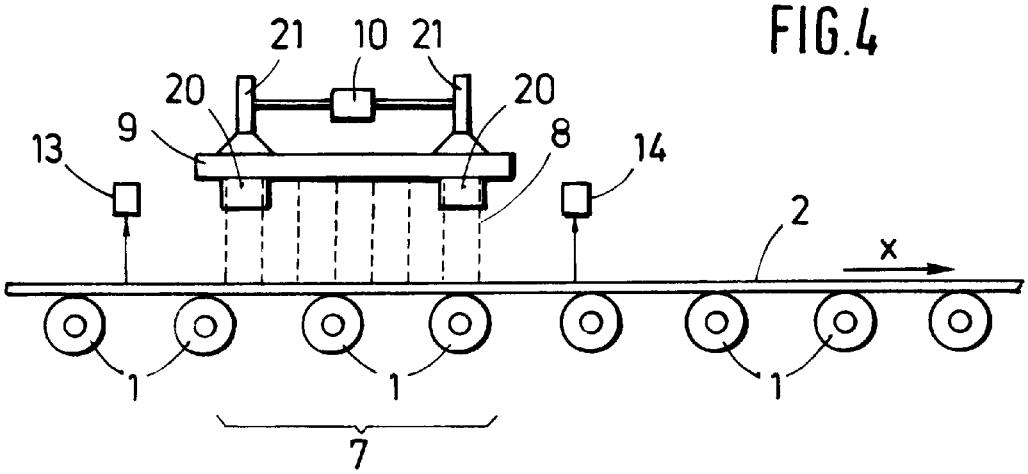
FIG. 4 shows a side view of the roller table of FIG. 1.

According to FIGS. 1 and 2, the shielding elements 9 are constructed as simple baffle plates 9, which are adjusted by threaded spindles 11. However, other embodiments are also conceivable. For example, according to FIG. 4, the shielding elements 9 are constructed as longitudinal ducts 9, which extend in the transporting direction x. The cooling medium 8, which is collected therein, is supplied to transverse ducts 20, which extend transversely to the transporting direction x. From the ducts 20, the cooling medium 8 is then discharged outside. As can be further seen in FIG. 4, the transverse ducts 20 are disposed between the adjusting driving mechanisms 10 and the roller table. Furthermore, according to FIG. 4, the shielding elements 9 are adjusted by roller chain driving mechanisms 21 instead of threaded spindles 11. The transverse ducts 20 protect the adjusting driving mechanisms 10 and/or the adjusting elements 11 and 21 against overheating and against any possible rising of the beginning 4 of the tape. The shielding elements 9 can be fastened as well as adjusted according to FIG. 4 at two positions in the transporting direction x.

According to the embodiment discussed above, the shielding elements 9 are disposed above the roller table. In principle, it would also be possible to dispose such a shielding arrangement below the roller table.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A method of adjusting two shielding elements, comprising the steps of:

transporting a metal strip having a width, a central axis, and edge regions on a roller table having a central axis, the metal strip having a temperature profile over the width thereof, shielding a cooling medium from the edge regions of the metal strip with adjusting shielding elements, and adjusting the shielding elements asymmetrically with respect to the central axis of the roller table so that the temperature profile, behind the shielding elements, as seen in a transporting direction of the strip, approximate to a nominal temperature profile.

2. The method of claim 1, comprising the step of determining a deviation of the tape central axis from the roller table central axis, and compensating the deviation by the asymmetric adjustment of the shielding elements.

3. The method of claim 1, comprising the step of determining an asymmetry of the temperature profile over the width of the strip in front of the shielding elements, as seen in the transporting direction, and compensating the asymmetry by the asymmetric adjustment of the shielding elements.

4. The method of claim 1 comprising the step of determining an asymmetry of the temperature profile over the tape width behind the shielding elements, as seen in the transporting direction, and compensating the asymmetry by the asymmetric adjustment of the shielding elements.

5. The method of claim 1, wherein the adjusting step includes mechanically adjusting the shielding elements, independently of one another, by respective adjusting driving mechanisms.

6. The method of claim 1, wherein the adjusting step comprises adjusting, with respect to the center (3) of the roller table, the shielding elements mechanically symmetrically by one adjusting driving mechanism and mechanically asymmetrically by a different driving mechanism.

7. The method of claim 5, comprising the step of pre-adjustment, before a beginning of the strips runs into the roller table, the adjusting driving mechanisms by a control unit; adjusting, after the beginning of the strip runs into the roller table, the shielding elements; transmitting the readjusted settings to the control unit and modifying the pre-adjustments with the control unit by means of the readjusted settings.

8. An assembly, comprising a roller table for transporting a metal strip having a width and opposite edge regions in a transporting direction; means for cooling the metal strip with a cooling medium as it moves along the roller table; shield elements for shielding the cooling medium from the edge regions of the metal strip; and driving means for asymmetrically adjusting the shield elements with respect to a central axis of the roller table.

9. The assembly of claim 8, further comprising sensor means for determining a deviation of a central axis of the metal strip from the central axis of the roller table, the sensor means being operationally connected with the driving means for controlling same in accordance with the deviation.

10. The assembly of claim 9, wherein the sensor means comprises means for detecting an asymmetry of a temperature profile over the strip width in front of the shielding elements, as seen in the transporting direction, and for controlling the driving means in accordance with the detected asymmetry.

11. The assembly of claim 9, wherein the sensor means comprises means for detecting an asymmetry of a temperature profile over the strip width behind the shielding elements, as seen in the transporting direction, and for controlling the driving means in accordance with the detected asymmetry.

12. The assembly of claim 8, wherein the drive means comprises a first driving mechanism for adjusting the shield elements mechanically symmetrically with respect to the roller table central axis, and a second driving mechanism for adjusting the shield elements mechanically asymmetrically.

13. The assembly of claim 8, wherein the driving means comprises a separate driving mechanism for each shielding element.

14. The assembly of claim 12, further comprising control means for pre-setting in the drive mechanisms pre-adjustments of the shielding elements and for modifying the pre-adjustments of the shielding elements in accordance with an actual adjustment of the shielding elements by the drive mechanisms.

15. The assembly of claim 8, wherein the shield elements are formed as longitudinal ducts extending in the transporting direction and arranged above the roller table, and wherein the cooling means comprises transverse ducts extending transverse to the transporting direction and supplied with the cooling medium from the longitudinal ducts.

16. The assembly of claim 15, wherein the transverse ducts are arranged between the adjusting driving mechanisms and the roller table.

17. The assembly of claim 8, wherein the drive means comprises one of threaded spindles, roller-chain means, and lever bars connected with respective shield elements for adjusting same; and drive mechanisms for operating the one of threaded spindles, roller-chain means, and the lever bar.

* * * * *